US012594484B2

(12) United States Patent
Neubauer et al.

(10) Patent No.: US 12,594,484 B2
(45) Date of Patent: Apr. 7, 2026

(54) MIXED MARTIAL ARTS EQUIPMENT

(71) Applicant: ZUFFA, LLC, Las Vegas, NV (US)

(72) Inventors: Jason Neubauer, Sammamish, WA (US); Noah Lanphear, Seattle, WA (US); Ryan Savage, Bothell, WA (US)

(73) Assignee: ZUFFA, LLC, Las Vegas, NV (US)

( * ) Notice: Subject to any disclaimer, the term of this patent is extended or adjusted under 35 U.S.C. 154(b) by 0 days.

(21) Appl. No.: 18/609,877

(22) Filed: Mar. 19, 2024

(65) Prior Publication Data

US 2024/0424380 A1 Dec. 26, 2024

Related U.S. Application Data

(60) Provisional application No. 63/509,783, filed on Jun. 23, 2023.

(51) Int. Cl.
*A63B 71/14* (2006.01)
*A41D 13/00* (2006.01)
(Continued)

(52) U.S. Cl.
CPC ..... *A63B 71/145* (2013.01); *A41D 13/00* (2013.01); *A41D 13/08* (2013.01); *A41D 13/081* (2013.01);
(Continued)

(58) Field of Classification Search
CPC .... A41D 13/08; A41D 13/081; A41D 13/082; A41D 13/084; A41D 13/00;
(Continued)

(56) References Cited

U.S. PATENT DOCUMENTS 4,603,439 A * 8/1986 Golomb ..... A63B 71/145 2/18
5,295,269 A * 3/1994 Ballard ..... A41D 19/01523 2/161.1

(Continued)

FOREIGN PATENT DOCUMENTS

CA 3077466 A1 12/2016
FR 2728440 A1 6/1996

OTHER PUBLICATIONS

International Searching Authority, Search Report and Written Opinion for International Application No. PCT/US2024/020619, Date of Mailing Jun. 17, 2024, 13 pages.

*Primary Examiner* — Khaled Annis
*Assistant Examiner* — Dakota Marin
(74) *Attorney, Agent, or Firm* — DICKINSON WRIGHT PLLC

(57) ABSTRACT

A fighting glove includes a first padding section and a second padding section disposed in a dorsal side of a user's hand, and a strapping section configured to secure the glove to the user's hand. The first padding section includes multiple impact absorption layers, multiple slip layers, and a contour layer, which are each partially bonded to each other. In particular, the hand regions of the layers are securely attached to each other, and the hand body regions of the layers are not attached to each other such that the hand body regions of the layers are free to move independently from each other. Further, the fighting glove includes an exterior layer formed by a single fabric material in each of the inner side and the outer side of the exterior layer to mitigate the glove from forming protrusions or rough features on the exterior layer of the glove.

17 Claims, 8 Drawing Sheets

(51) Int. Cl.
*A41D 13/08* (2006.01)
*A41D 19/015* (2006.01)

(52) U.S. Cl.
CPC ..... *A41D 13/082* (2013.01); *A41D 13/084* (2013.01); *A41D 19/015* (2013.01); *A41D 19/01523* (2013.01); *A41D 19/01582* (2013.01); *A41D 19/01588* (2013.01); *A63B 71/14* (2013.01); *A63B 2244/102* (2013.01)

(58) Field of Classification Search
CPC ..... A41D 19/01582; A41D 19/01588; A41D 19/01523; A41D 19/015; A63B 71/145; A63B 71/14; A63B 2244/102
USPC ..... 2/18
See application file for complete search history.

(56) References Cited

U.S. PATENT DOCUMENTS 5,537,692 A * 7/1996 Dorr ..... A41D 19/01588 2/161.1
5,898,938 A 5/1999 Baylor et al.
6,226,795 B1 5/2001 Winningham
6,430,751 B1 * 8/2002 Tourbier ..... A41D 19/01582 2/160
6,691,315 B1 * 2/2004 Clarke ..... A63B 71/145 2/18
7,284,283 B2 * 10/2007 Mack ..... A41D 27/245 2/161.6
D637,765 S 5/2011 Singh
8,646,113 B2 2/2014 Clement et al.
8,726,418 B2 * 5/2014 DeBlasis ..... A41F 1/06 2/161.1
D706,992 S 6/2014 Bermudez
9,079,093 B2 * 7/2015 Clement ..... A63B 71/145
9,480,902 B2 * 11/2016 House ..... A63B 71/141
9,808,038 B2 * 11/2017 Long ..... A41D 19/01523
10,004,975 B2 * 6/2018 Clement ..... A63B 71/145
10,376,770 B2 * 8/2019 Wittman ..... A63B 71/145
10,925,334 B1 * 2/2021 Husser ..... A41D 19/0048
11,344,788 B1 * 5/2022 Wittman ..... A63B 71/145
11,541,297 B2 * 1/2023 Bisaillon ..... A41D 13/08
11,771,979 B2 * 10/2023 Halldin ..... A63B 71/141 2/161.1
12,178,267 B2 * 12/2024 Kamphuis ..... A63B 71/141
2003/0217582 A1 * 11/2003 Reinbold ..... A63B 71/06 73/12.09
2004/0177431 A1 * 9/2004 Ferrer ..... A41D 19/01523 2/161.8
2005/0076418 A1 * 4/2005 von Blucher ..... A62D 5/00 2/161.6
2011/0277205 A1 * 11/2011 Cuadrado ..... A41D 19/01523 2/18
2013/0019366 A1 * 1/2013 Mechling ..... A41D 13/06 2/18
2016/0367881 A1 * 12/2016 Le ..... A41F 1/06
2017/0001097 A1 * 1/2017 Ferrer ..... A41D 19/01523
2018/0133582 A1 * 5/2018 Sharp ..... A41D 13/088
2022/0401816 A1 12/2022 Wittman
2024/0260693 A1 * 8/2024 Kamphuis ..... A63B 71/141

* cited by examiner

MIXED MARTIAL ARTS EQUIPMENT

This application claims priority to and the benefit of U.S. Prov. Pat. App. No. 63/509,783 filed Jun. 23, 2023, which is incorporated herein by reference in its entirety.

TECHNICAL FIELD

The present disclosure relates to a mixed martial arts (MMA) equipment, and more particularly relates to a glove designed for improved fit and function in the MMA.

BACKGROUND

The statements in this section merely provide background information related to the present disclosure and may not constitute prior art.

Combat athletes, especially mixed martial arts (MMA) fighters, use gloves that, in general, are cumbersome, thick, non-form-fitting, and lack in adequate wrist and hand support. These gloves, with repetitive use, quickly lose the ability to maintain proper fit and function. This can lead to a decrease in force generation and related hand and first functioning, and can also lead to injury of the fighters' hand. Another shortcoming of these conventional gloves is that, when the glove strikes a target or opponent, the hand can be loose and the wrist can be unstable. It can therefore be appreciated that force loss and injury can be experienced by the athlete during a training and a competitive event.

Further, a conventional glove may have protrusions and other rough features on the exterior layer of the glove. These protrusions and rough features may cut the opponent's skin and cause bleeding. Also, the fighter jabs and throws punches during a fight. As the opponent maneuvers to avoid being hit, the glove may graze his/her skin. So, the protrusions and rough features of the glove may cut the fighter and cause the fighter to start bleeding. If excessive, the fight may be stopped or temporarily suspended until the bleeding can be controlled.

In addition, the fighters tape up their hands to provide support and to prevent hand fractures when punching. Unfortunately, the process of taping up a fighter's hand is quite cumbersome. The fighters will wrap their hands with a strip of cloth material numerous times, and each wrapping is supposed to provide additional wrist and bone support to mitigate hand fracture their hands when punching. Unfortunately, however, the fighters still fracture to their hands when punching. Moreover, since the strip of cloth material must be wrapped around the fighters' hand numerous times, the wrapping is quite thick which makes inserting the hand into a glove more difficult, thereby requiring the fighters to wrap their hands again. Accordingly, there is a need in the art for improved fighting gloves.

SUMMARY

The present disclosure relates to an MMA glove that advances kinetic functionality with consideration to materials and technologies, and mitigates hand injuries and also bone breaks. Further, the MMA glove of the present disclosure minimizes the risk of cuts, lacerations and/or abrasions caused by exposed seams and/or protrusions or rough features of the glove that can cause open wounds. According to an exemplary aspect of the present disclosure, the glove includes at least one padding section disposed in a dorsal side of a user's hand and a strapping section configured to secure the glove to the user's hand. At least one padding section includes at least one absorption layer and at least one slip layer arranged through a thickness of the at least one padding section. Further, the at least one absorption layer and the at least one slip layer are attached to each other.

According to another aspect of the present disclosure, a glove includes a strapping section configured to secure the glove to the user's hand and a padding section formed with a contour layer, at least one absorption layer, and at least one slip layer. Each of the contour layer, the at least one absorption layer, and the at least one slip layer has a finger region and a hand body region. Further, the finger regions of the layers are securely attached to each other.

Further details and benefits will become apparent from the following detailed description of the appended drawings. The drawings are provided herewith purely for illustrative purposes and are not intended to limit the scope of the present disclosure.

BRIEF DESCRIPTION OF DRAWINGS

In order that the disclosure may be well understood, there will now be described various forms thereof, given by way of example, reference being made to the accompanying drawings, in which.

Figure 1A:
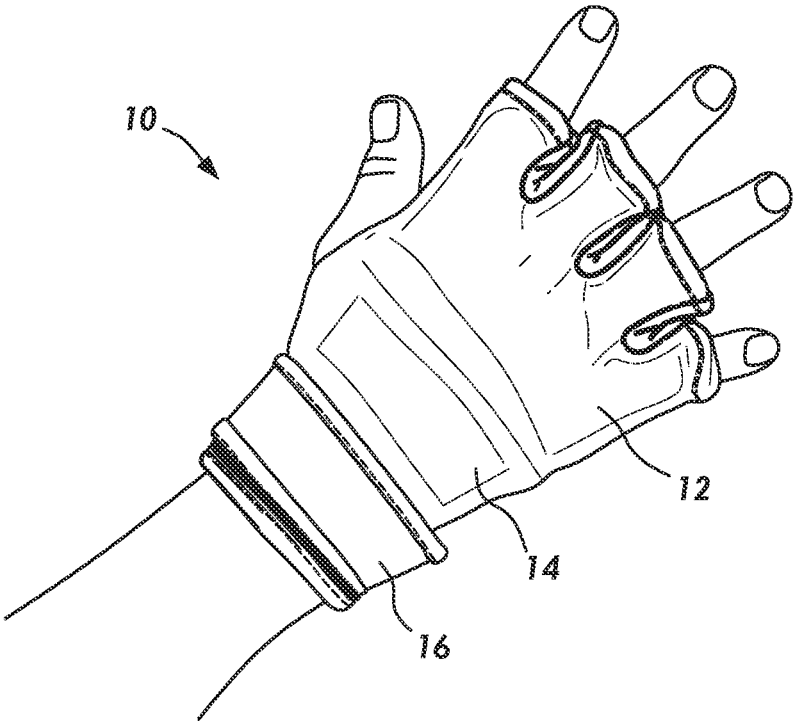
FIG. 1A is a top view of a glove worn by a user's hand in a released state in accordance with an embodiment of the present disclosure.

The drawings described herein are for illustration purposes only and are not intended to limit the scope of the present disclosure in any way.

DETAILED DESCRIPTION

The following description is merely exemplary in nature and is in no way intended to limit the present disclosure or its application or uses. It should be understood that throughout the drawings, corresponding reference numerals indicate like or corresponding parts and features.

Figure 1B:
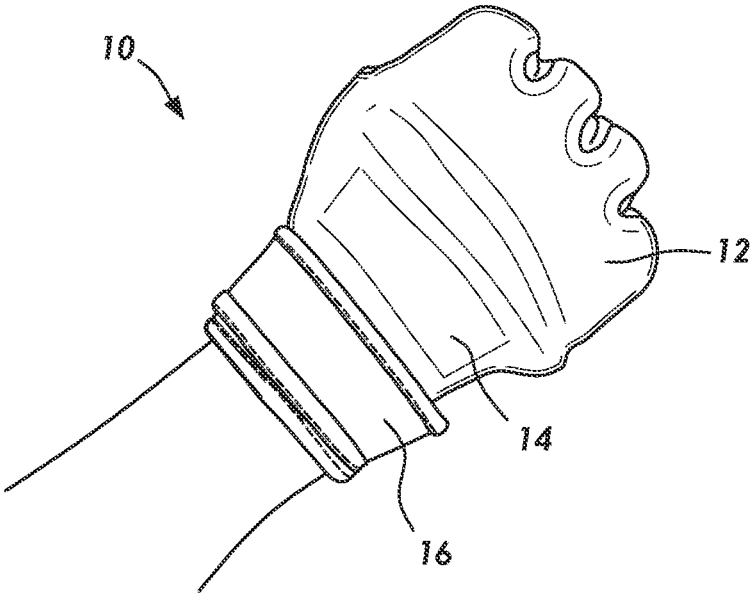
FIG. 1B is a top view of the glove worn by the user's hand in a clenched state in accordance with an embodiment of the present disclosure.

Referring now to the drawings, FIG. 1A shows a mixed martial art (MMA) glove 10 worn by a user in a relaxed state of the user's hand. FIG. 1B shows the glove 10 worn by the user in a clenched state of the user's hand. As shown in FIGS. 1A and 1B, the glove 10 includes a first padding section 12, a second padding section 14, and a strapping section 16. In accordance with a form of the present disclosure, the glove 10 does not have any seams, significant protrusion, or rough features on the dorsal side, lateral sides or fingertips of the user's hand (i.e., outer side, lateral side and distal ends of the glove's exterior layer). As such, when the user (i.e., a fighter or a trainer) fights in a match or training, the glove 10 is configured to reduce or mitigate the risk of cuts, lacerations and/or abrasions caused by exposed seams, protrusions, and/or rough features of the glove 10.

Figure 2A:
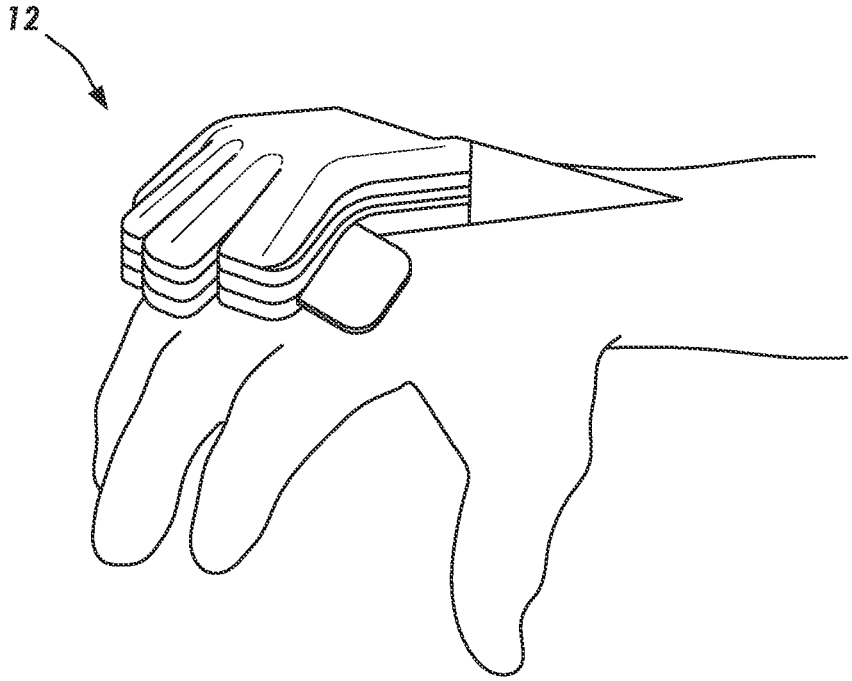
FIG. 2A is a perspective view of a first padding section of the glove of FIG. 1A.
Figure 2B:
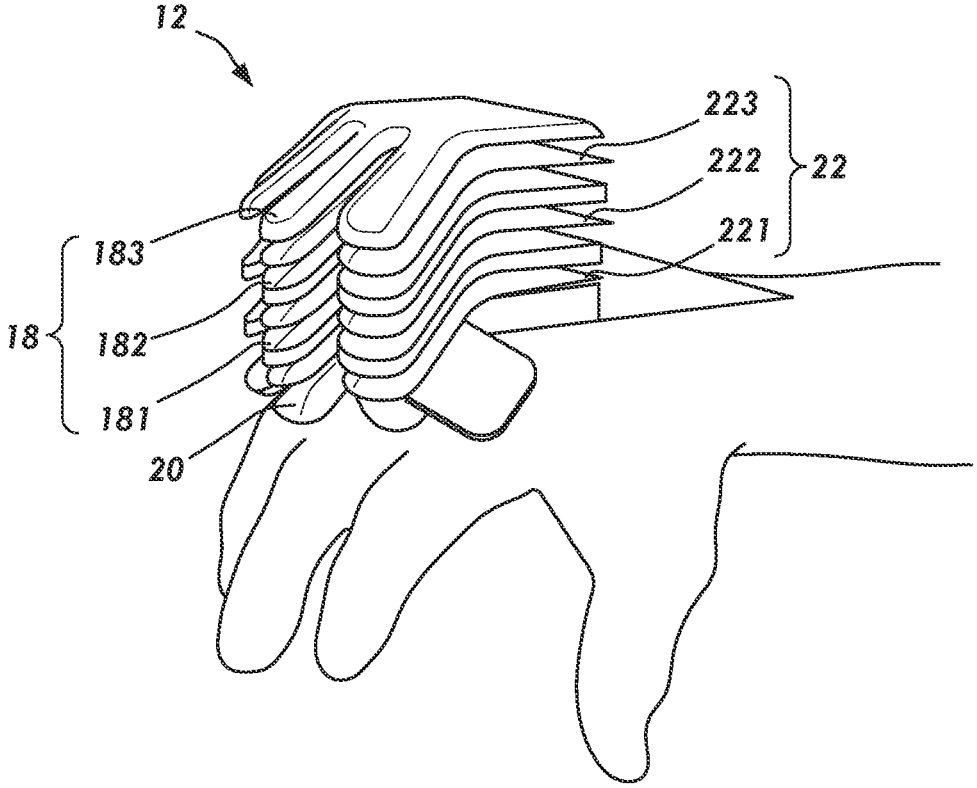
FIG. 2B is an exploded view of the first padding section of FIG. 2A.

In accordance with a form of the present disclosure, the first padding section 12 of the glove 10 is generally formed with multiple layers, which can be at least partially coupled (e.g., bonded) to each other. FIG. 2A shows the first padding section 12 having multiple layers. In some embodiments, the layers can be bonded to each other as a single unit. FIG. 2B shows an exploded view of the first padding section 12 having the multiple layers. As shown in FIG. 2B, for example, the first padding section 12 of the glove 10 can include three impact absorption layers 18 having a first mid-absorption layer 181, a second mid-absorption layer 182, and a top absorption layer 183, and a contour layer 20, which is close to the dorsal side of the user's hand. Further, the first padding section 12 includes slip layers 22 (i.e., load distribution layers) having a first slip layer 221, a second slip layer 222, and a third slip layer 223, which are each configured to distribute an impact load between the multiple impact absorption layers 18 and the contour layer 20 when the user hits an opponent or a training partner.

As shown in FIG. 2B, the first slip layer 221 is disposed between the contour layer 20 and the first mid-absorption layer 181, the second slip layer 222 is disposed between the first mid-absorption layer 181 and the second mid-absorption layer 182, and the third slip layer 223 is disposed between the second mid-absorption layer 182 and the top absorption layer 183. Accordingly, each of the slip layers 22 is arranged between each of the impact absorption layers 18 and the contour layer 20 through a thickness of the first padding section 12, and is configured to distribute the impact load in the first padding section 12 to reduce the risk of injury to the user's hand. In accordance with other forms of the present disclosure, the absorption layers 18, the contour layer 20, and the slip layers 22 may be arranged in different patterns or methods in the first padding section 12.

Figure 3A:
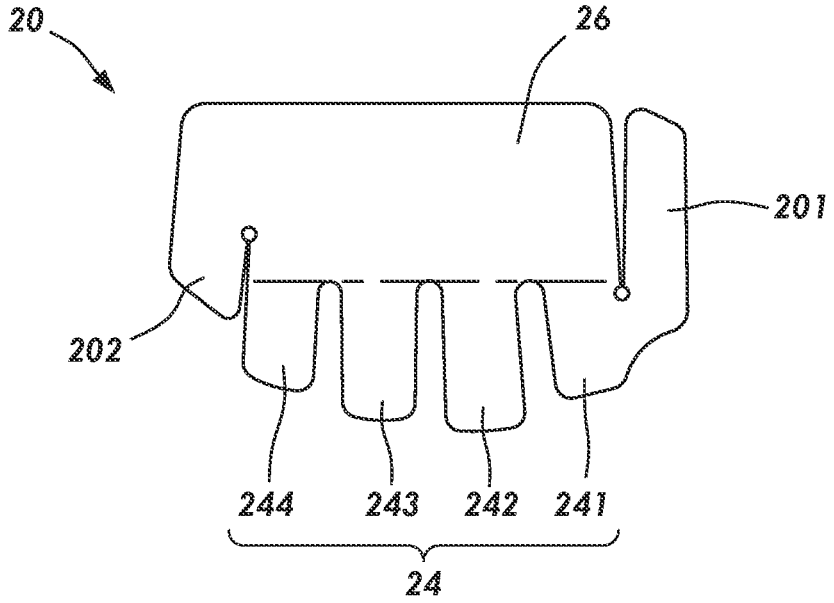
FIG. 3A is a plan view of a contour layer in the first padding section of FIG. 2A.
Figure 3B:
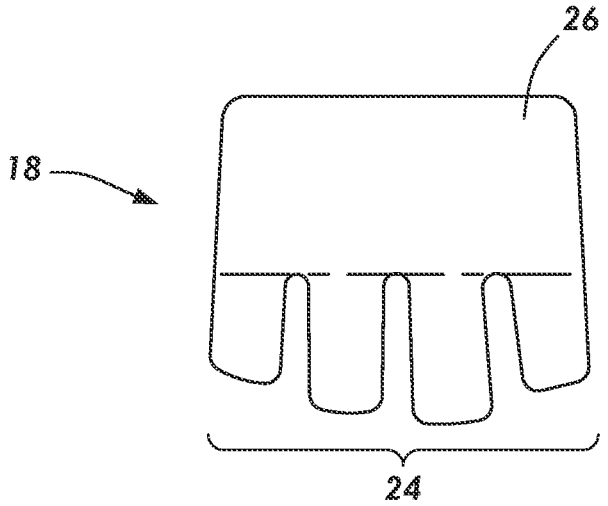
FIG. 3B is a plan view of an impact absorption layer in the first padding section of FIG. 2A.
Figure 3C:
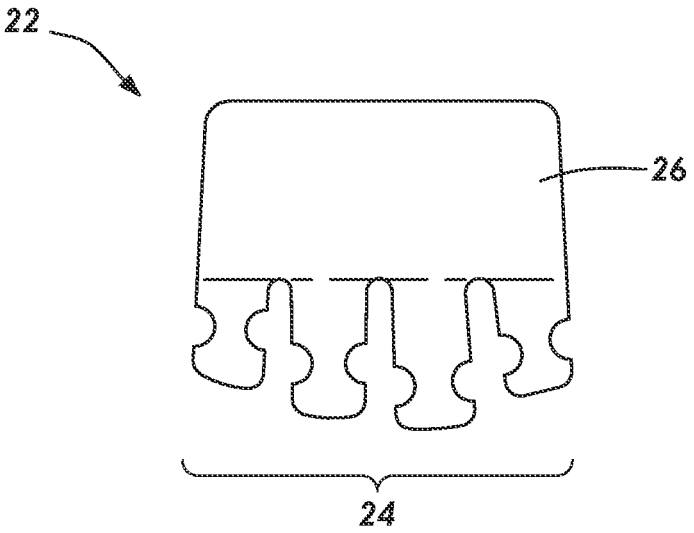
FIG. 3C is a plan view of a slip layer in the first padding section of FIG. 2A.

FIGS. 3A-3C show the shapes and dimensions (in some embodiments) of the layers 18, 20, and 22 formed in the first padding section 12. FIG. 3A shows the shape and dimension of the contour layer 20, FIG. 3B shows the shape and dimension of the impact absorption layers 18, and FIG. 3C shows the shape of the slip layers 22, in some versions. As shown in FIGS. 3A-3C, each of the layers 18, 20, and 22 has a hand body region 26 and a finger region 24 extending from the hand body region 26 along a length of the user's hand. Further, the finger region 24 includes four finger sections such as an index finger section 241, a middle finger section 242, a ring finger section 243, and a small finger section 244. Accordingly, the first padding section 12 has two regions such as the finger region 24 and the hand body region 26 (see also FIG. 4). As shown in FIG. 3A, the contour layer 20 further includes a first extension 201, which extends laterally from the index finger section 241 and a second extension 202, which extends laterally from the small finger section 244 for the lateral side protection of the user's hand. The first and second extensions 201 and 202 of the contour layer 20 is configured to protect the lateral side of the user's hand during the fight or training. Further, as shown in FIG. 3A, the contour layer 20 has approximately 97 mm in a length (i.e., the longitudinal direction of the user's hand) and approximately 153.9 mm in a width (i.e., the lateral direction of the user's hand), which is defined as the medium size of the glove 10. The dimension of the contour layer 20 may be adjusted according to the different sizes of the glove 10 such as a small, a large, an extra-large size, etc.

As shown in FIG. 3B, each of the first mid-absorption layer 181, the second mid-absorption layer 182, and the top absorption layer 183 can have the same shape and dimension. Unlike the contour layer 20, in FIG. 3B, the absorption layers 18 do not have any lateral extensions for the lateral side protection, in one example. In another approach, however, the absorption layers 18 may have lateral extensions for the lateral side protection of the user's hand. Further, embodiments of each of the absorption layers 18 has approximately 97 mm in a length and approximately 104 mm in a width, which is also defined as the medium size of the glove 10. The dimension of the absorption layers 18 may be adjusted according to the different sizes of the glove 10. In addition, FIG. 3C shows the shape of the slip layers 22, which can have all the same shape and size. In another approach, however, each of the slip layers 22 may have different shapes and sizes. Further, the size of the slip layers 22 may be adjusted according to the different sizes of the glove 10. In accordance with a form of the present disclosure, some versions of the slip layers 22 are each formed with a Teflon material, which is thin and flexible to bend easily.

Figure 4:
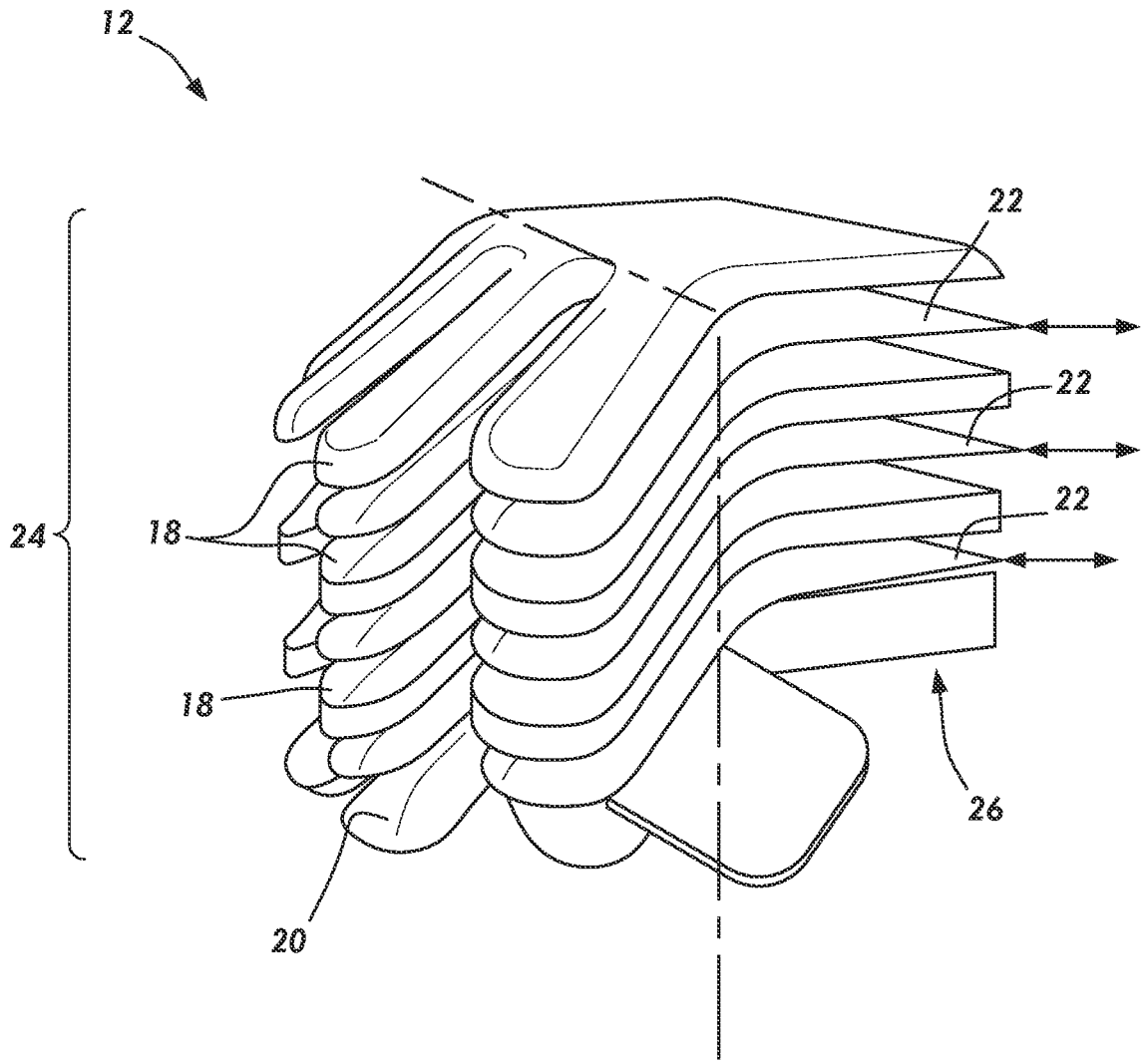
FIG. 4 is a perspective view of a finger region and a hand body region formed in the first padding section of FIG. 2A.

FIG. 4 shows the first padding section 12 having the absorption layers 18, the contour layers 20, and the slip layers 22, which are each attached to each other, in one example. As shown in FIG. 4, the finger region 24 of the first padding section 12 is securely attached to each other by a bonding method such as a gluing, a bonding with an adhesive material, a laminating, etc. However, the hand body region 26 is not attached to each other (i.e., only the finger region 24 of the layers 18, 20, and 22 are bonded to each other), in one example. Accordingly, in the first padding section 12, the finger regions 24 of the layers 18, 20, and 22 are securely attached to each other, but the hand body regions 26 of the layers 18, 20, and 22 are separated from each other as shown in FIG. 4. Due to the hand body region 26 being separated and independently movable in the first padding section 12, the impact load during the fight or training is evenly distributed to each of the absorption layers 18 and the contour layer 20 such that the injury of the user's hand can be reduced.

The impact absorption layers 18 may be each fabricated from open or close foam such as PORON foam or EVA foam, rubber, sponge, gel, injection foam molding, horsehair, cotton fiber or combinations thereof. Further, the absorption layers 18 may be fabricated from high density foam, low density foam, or mid-density foam. In accordance with a form of the present disclosure, for example, the absorption layers 18 are each fabricated from a polymer material such as Vinyl Nitrile Polymer to absorb the impact load during the fight or training. In particular, the first and second mid-absorption layers 181 and 182 are fabricated from a high density foam, and the top absorption layer 183 is fabricated from a low density foam, in some versions.

Figure 5A:
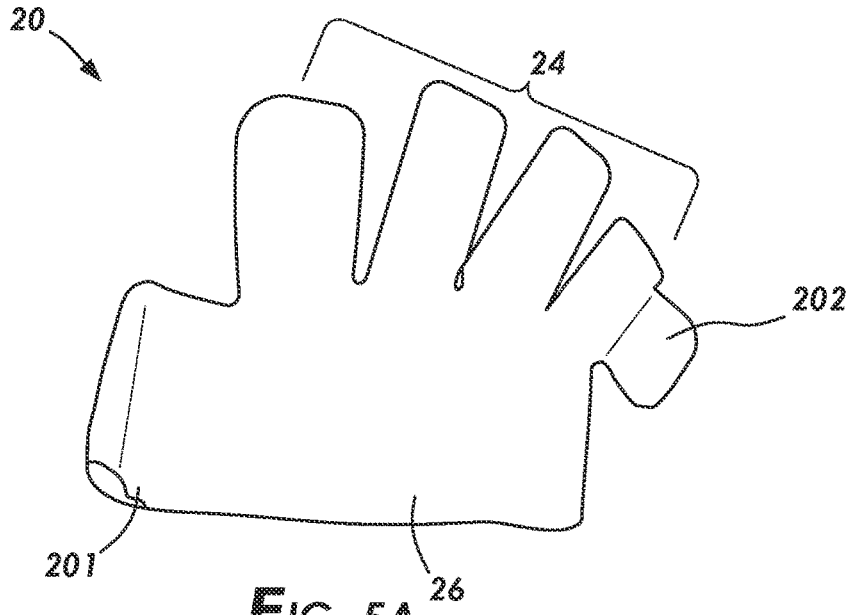
FIG. 5A is a plan view of a preformed contour layer in a first padding section in accordance with an embodiment of the present disclosure.
Figure 5B:
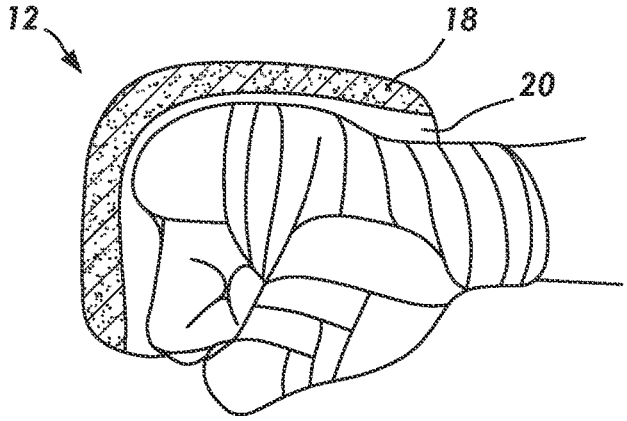
FIG. 5B is a side-cut view of the glove worn by a user's hand including the preformed contour layer of FIG. 5A.
Figure 5C:
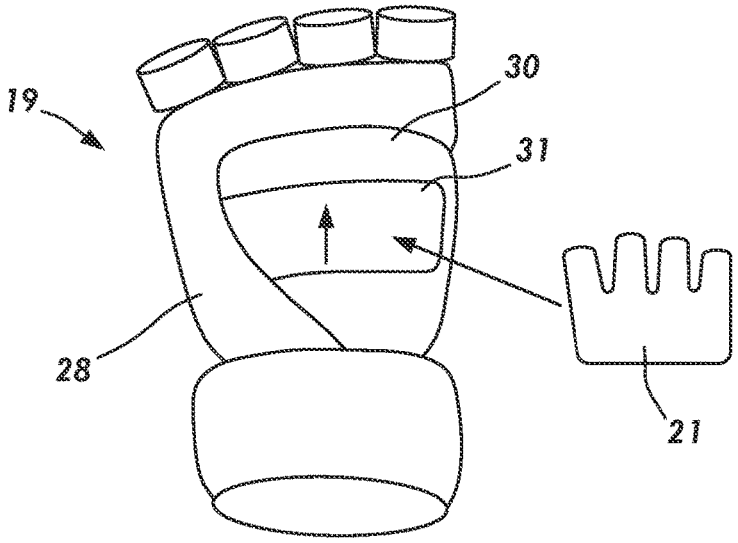
FIG. 5C is a plan view of a glove having a pocket on an inner side of an exterior layer with a replaceable contour layer in accordance with an embodiment of the present disclosure.

FIG. 5A shows an example of the contour layer 20, which is preformed according to the dorsal side shape of the user's hand. Each glove can be customed-formed to each unique hand shape of each user. The contour layer 20 is fabricated from a low density form, which is the same material as the top absorption layer 183 such that the contour layer 20 is configured to be flexible and comfortable for the user's hand when the user's hand is in the clenched state or the relaxed state. As shown in FIG. 5A, the contour layer 20 is preformed to the user's hand in the relaxed state such that when the user's hand is inserted into the glove 10, the user's hand is comfortably fitted inside the glove 10. Further, in the first padding section 12 of the glove 10, the preformed contour layer 20 mitigates the glove 10 from forming wrinkles, folds, and/or other rough features that might cut the opponent's or training partner's skin. In addition, the contour layer 20 of the first padding section 12 could be customized to preform the user's hand shape for fighters. As shown in FIG. 5B, further, the preformed contour layer 20 may be shaped and sized to provide protection to the knuckles when the user's hand is in the clenched state because there is no looseness (i.e., tightened) between the user's hand and the contour layer 20. In another approach, as shown in FIG. 5C, the exterior layer 28 of the glove 10 has an inner side 30 formed with a pocket 31 to receive a contour layer 21. In FIG. 5C, the contour layer 21 is replaceable and inserted into the pocket 31 instead of the contour layer 20 bonded to the absorption layers 18 or the slip layers 22 (see FIG. 4). As such, for example, the contour layer 21 inside the pocket 31 could be replaced when another user wants to use the glove with a new contour layer or a customized contour layer.

Figure 6A:
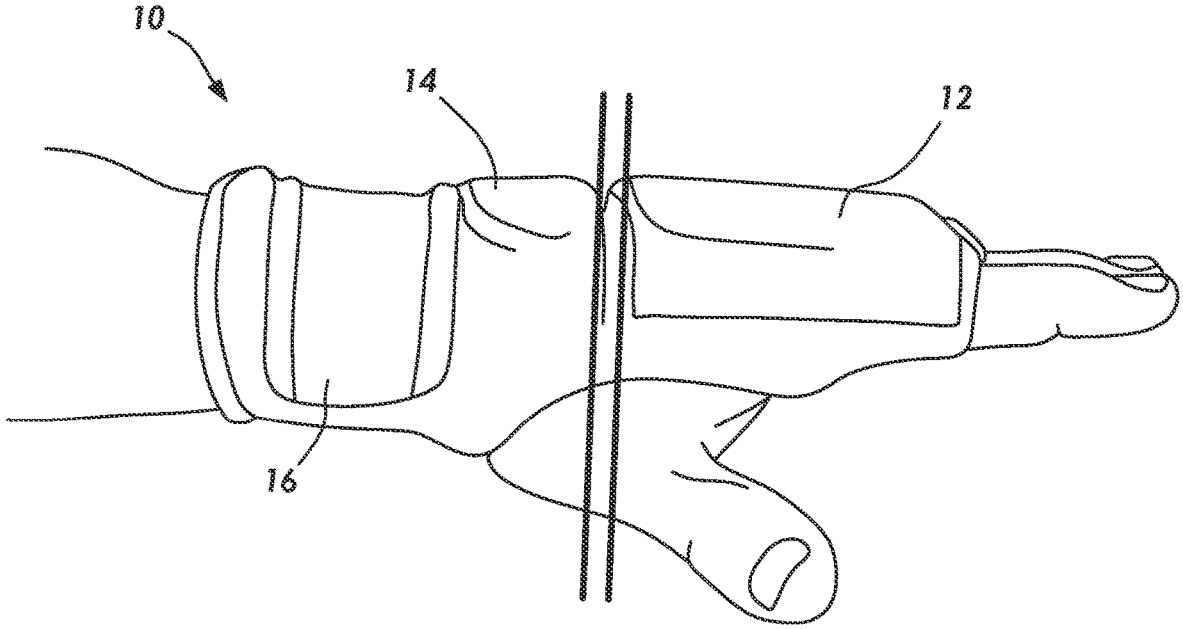
FIG. 6A is a side view of the glove worn by the user's hand in the released state of FIG. 1A.
Figure 6B:
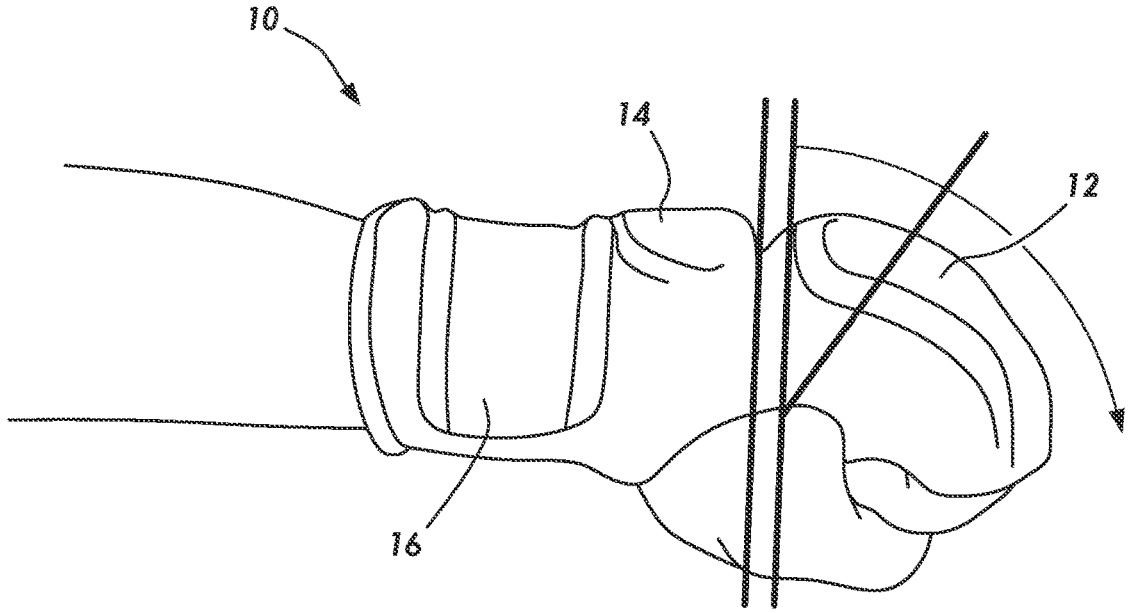
FIG. 6B is a side view of the glove worn by the user's hand in the clenched state of FIG. 1B.

Referring back to FIGS. 1A and 1B, the glove 10 includes the second padding section 14, which is another padding section separated from the first padding section 12. As shown in FIGS. 6A and 6B, the second padding section 14 is disposed between the first padding section 12 and the strapping section 16 by a stitching method, and is formed with multiple layers to absorb the impact load during the fight or training. In accordance with a form of the present disclosure, the second padding section 14 of the glove 10 may be fabricated from open or close foam, rubber, sponge, gel, injection foam molding, horsehair, cotton fiber or combination thereof. In particular, the second padding section 14 is fabricated from the same material as the absorption layers 18 of the first padding section 12. Further, as shown in FIGS. 6A and 6B, due to the separation between the first padding section 12 and the second padding section 14, the glove 10 worn by the user's hand is flexibly and comfortably clenched or released. As shown in FIG. 6B, the second padding section 14 is configured to be flexible and also stiffened on the impact load. Further, the glove 10 has a smooth profile of the first and second padding sections 12 and 14 when the user's hand is in the clenched state or released state such that the glove 10 mitigates cuts of the opponent's or training partner's skin and/or reduces the injury of the user's hand.

Figure 7A:
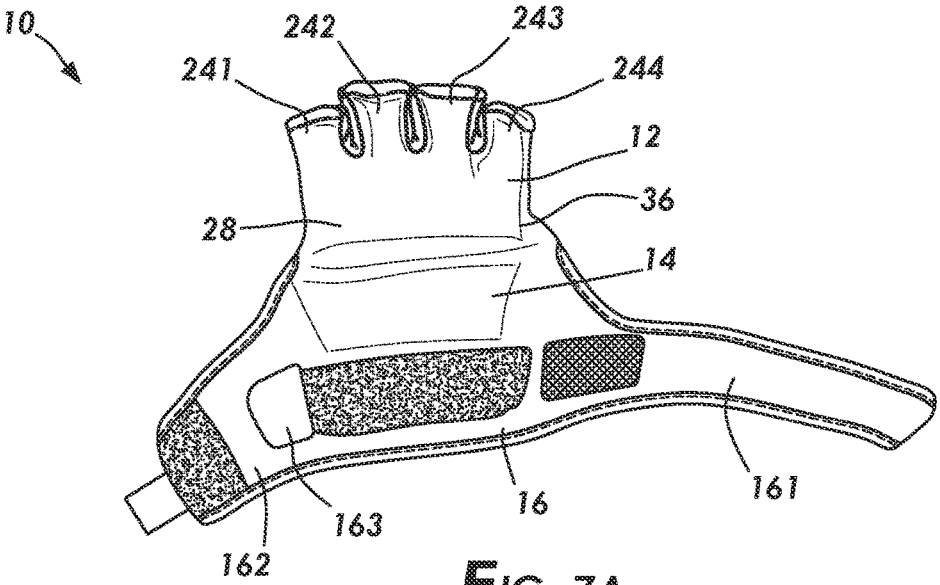
FIG. 7A is a plan view of an outer side of an exterior layer of the glove of FIG. 1A.

FIG. 7A shows an exterior layer 28 having an outer side 29 (see FIG. 7B) and an inner side 30 (see FIG. 7C), which are joined to form the exterior layer 28 of the glove 10. The exterior layer 28 may be wrapped around the first padding section 12 and the second padding section 14 so that the exterior layer 28 presses against the first and second padding sections 12 and 14. The exterior layer 28 formed with the outer side 29 and the inner side 30 compress the padding sections 12 and 14 such that there is less movement and wrinkles of the exterior layer 28. Further, the outer side 29 and inner side 30 are each formed with a single piece fabric to reduce the number of the seaming locations on the exterior layer 28. Accordingly, the reduced seaming locations on the exterior layer 28 are configured to mitigate the exterior layer 28 of the glove 10 from forming wrinkles, protrusions, or rough features.

Figure 7B:
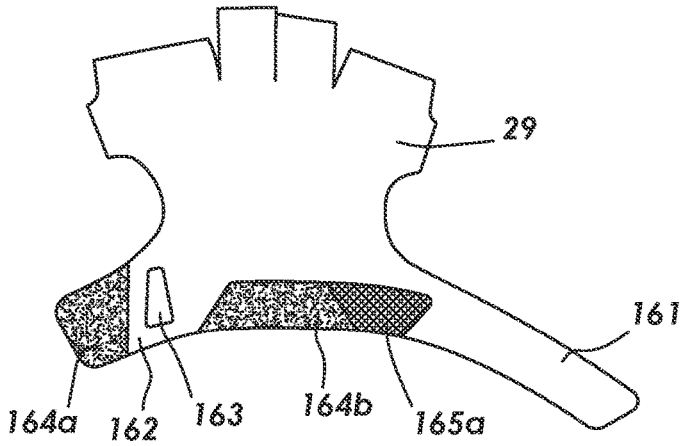
FIG. 7B is a plan view of the outer side of the exterior layer of FIG. 7A.
Figure 7C:
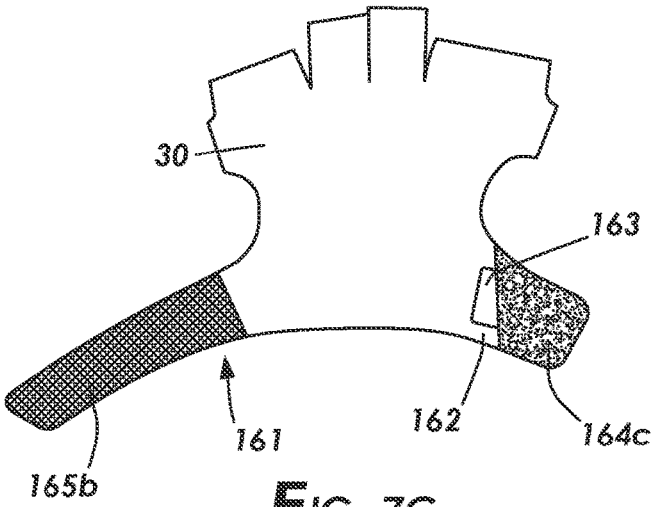
FIG. 7C is a plan view of an inner side of the exterior layer of FIG. 7B.

In accordance with a form of the present disclosure, the exterior layer 28 of the glove 10 may be fabricated from a durable material such as linens, leather (e.g., composite leather, synthetic leather, etc.), or any other applicable materials. For example, FIG. 7B shows one piece fabric of the outer side 29 and FIG. 7C shows one piece fabric of the inner side 30, which are joined to seam around the edge lines of the inner and outer sides 29 and 30. As shown in FIG. 7A, the seam lines 34 (i.e., seaming locations) are not formed on the outer side 29 of the exterior layer 28 to prevent any cut and laceration of the opponent's or training partner's skin. Instead, the seam lines 34 may be disposed in the inner side 30 of the exterior layer 28 and/or between each of the finger sections 241, 242, 243, and 244 (see FIGS. 7 and 8). In particular, the seam lines 34 of the finger sections 241, 242, 243, and 244 are each disposed near the inner side 30 of the exterior layer 28. Accordingly, as shown in FIG. 7A of the present disclosure, the exterior layer 28 of the glove 10 is configured to reduce cut, laceration, or injury to the opponent or training partner during the fight or training.

Figure 8:
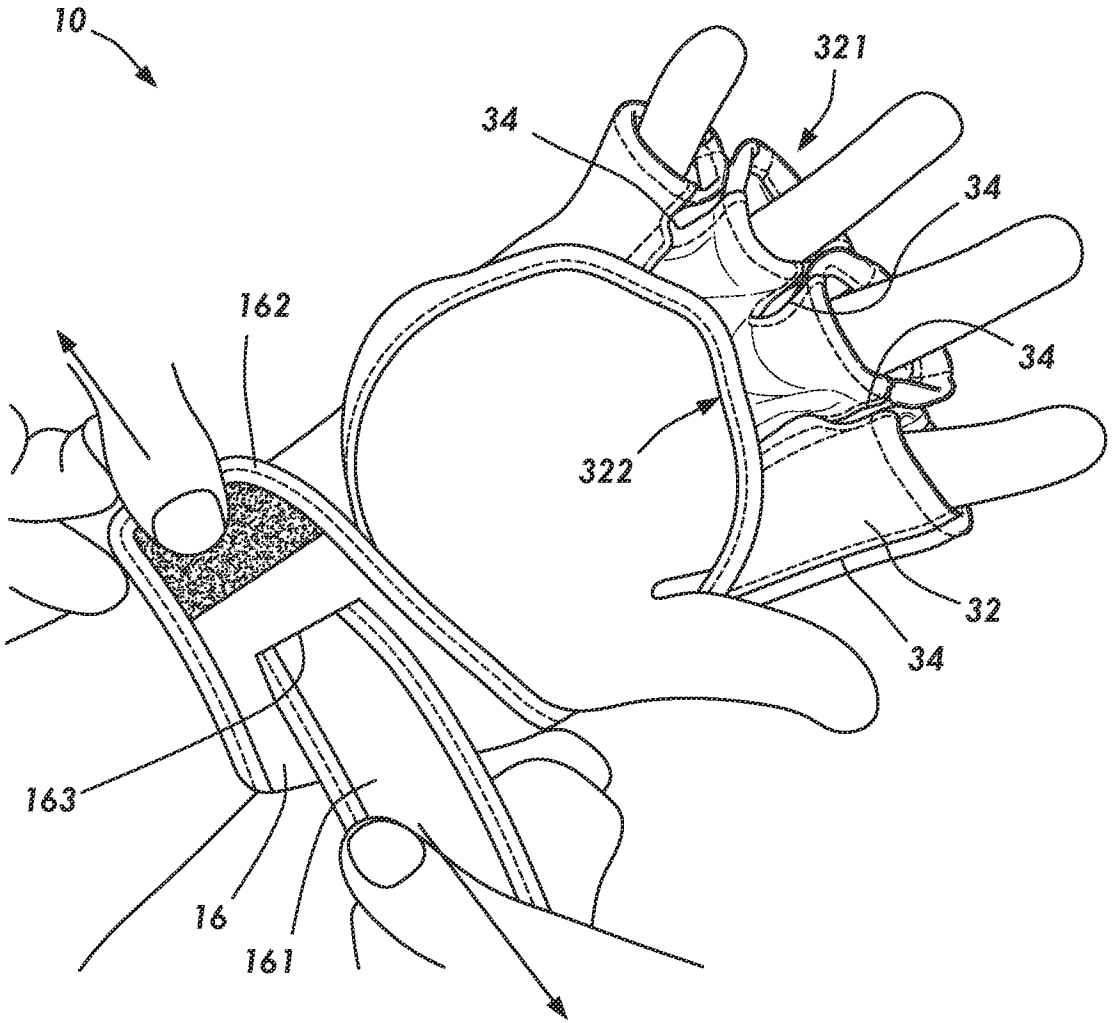
FIG. 8 is a bottom view of the glove worn by the user's hand of FIG. 1A.

Referring to FIG. 8, four finger holes of the glove 10 may be formed by attaching an additional single fabric 32. The finger fabric 32 attached to the exterior layer 28 may form four finger holes for receiving the user's fingers. As shown in FIG. 8, distal end portions 321 of the finger fabric 32 terminate at the middle of the fingers of the user's hand and is sewn to the distal end 321 of the exterior layer 28, which is defined as one of the seaming locations of the glove 10. As shown in FIG. 8, the finger fabric 32 may be attached to the first padding section 12 of the glove 10 for forming the four finger holes. The proximal end 322 of the finger fabric 32 may be aligned to the finger joints of the user's hand, and shown as being disposed below the finger joints. However, it is also contemplated that the proximal end 322 of the finger fabric 32 may be aligned to the finger joints for the purposes of allowing the user's hand to more easily grip his/her opponents arm or appendages. Accordingly, the seaming locations 34 sewn between the exterior layer 28 and the finger fabric 32 may be generally arranged on the palmer side of the user's hand to reduce the cut or laceration of the opponent's or training partner's skin.

Referring back to FIG. 7A, the glove 10 has multiple stitching locations 36 on the outer side 29 of the exterior layer 28 instead of the seaming locations 34 sewn with at least two piece fabrics. As shown in FIG. 7A, for example, the first padding section 12 and the second padding section 14 are separately disposed by a stitching on the outer side 29 of the exterior layer 28 without any protrusions or rough features. In the glove 10, as shown in FIG. 7A, the stitching locations 36 may be formed on the outer side 29 of the exterior layer 28 because the stitching locations 36 are generally configured to be ornamental as well as to reinforce the shape of the glove 10. However, the seaming locations 34 may be formed on the inner side 30 of the exterior layer 28 and/or the palmer side of the user's hand because protrusions or rough features may be formed in the seaming locations 34.

Referring back to FIGS. 1A and 1B, the glove 10 includes the strapping section 16 to secure the glove 10 to the user's hand when the glove 10 is worn by the user. The user inserts his/her hand into the glove 10 and secures the straps by way of hook and loop attachment system. Referring back to FIGS. 7B and 7C, the glove 10 has a first strap 161 and a second strap 162, which are each formed in the securing section 16. The first strap 161 is generally longer than the second strap 162, and the second strap 162 has an opening 163. Each of the first and second straps 162 and 163 has hooks and loops to attach to each other. A first loop 164*a*, a second loop 164*b*, and a first hook 165*a* are each formed in the outer side 29 of the exterior layer 28 of FIG. 7A, and a third loop 164*c* and a second hook 165*b* are each formed in the inner side 30 of the exterior layer 28.

Further, in FIG. 8, the user's fingers are each inserted into the finger holes. After the insertion of the fingers into the finger holes, the first and second straps 161 and 162 of the strapping section 16 are each wrapped around the wrist of the user to secure the glove 10. As shown in FIG. 8, in this instance, the first strap 161 is inserted through the opening 163 of the second strap 162, crossed the second strap 162, and further wrapped around the user's wrist. In this instance, as shown in FIGS. 7B and 7C, the third loop 164*c* of the second strap 162 is attached to the first hook 165*a* of the first strap 161 such that the second strap 162 is securely attached to the first strap 161. Thereafter, the first strap 161 passed through the opening 163 of the second strap 162 is further wrapped around the user's wrist. In this instance, the second hook 165*b* of the first strap 161 is attached to each of the first and second loops 164*a* and 164*b* to secure the first strap 161 (see FIGS. 7B and 7C). While the first and second straps 161 and 162 are each wrapped around the user's wrist, the straps 161 and 162 are each pulled in an opposite direction (see arrows in FIG. 8) from each other to be securely engaged to each other such that the strapping section 16 is configured to secure the glove 10 to the user's hand. In accordance with other forms of the present disclosure, the different strapping system of the glove 10 may be used to secure the glove 10 to the user's hand.

The various embodiments disclosed herein are discussed in relation to MMA sports. However, the various embodiments may be used in the individual fighting sports that comprise MMA sports including but not limited to Muay Thai, boxing, kick boxing, and any other type of fighting sports.

The foregoing description of various forms of the invention has been presented for purposes of illustration and description. It is not intended to be exhaustive or to limit the invention to the precise forms disclosed. Numerous modifications or variations are possible in light of the above teachings. The forms discussed were chosen and described to provide the best illustration of the principles of the invention and its practical application to thereby enable one of ordinary skill in the art to utilize the invention in various forms and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A glove comprising:

at least one padding section configured to be disposed adjacent to a dorsal side of a user's hand; and a strapping section configured to secure the glove to the user's hand, wherein the at least one padding section includes at least one absorption layer and at least one slip layer arranged through a thickness of the at least one padding section, wherein the at least one absorption layer and the at least one slip layer are attached to each other, wherein the at least one padding section further includes a contour layer disposed adjacent to the dorsal side of the user's hand such that the contour layer, at least one slip layer, and the at least one absorption layer are each arranged through the thickness of the at least one padding section, and wherein the contour layer includes a first extension extending laterally from an index finger section and a second extension extending laterally from a small finger section, and each of the first and second extensions includes a portion separated from a hand body region of the contour layer for protecting a lateral side of the user's hand.

2. The glove of claim 1, wherein the at least one slip layer is located between the contour layer and the at least one absorption layer, and configured to distribute an impact load exerted on the glove.

3. The glove of claim 1, wherein each of the at least one absorption layer, the at least one slip layer, and the contour layer has a hand body region and a finger region such that the at least one padding section is formed with the finger region and the hand body region.

4. The glove of claim 3, wherein the finger region of each of the layers is securely attached to each other and the hand body region of each of the layers is not attached such that the hand body region of each layer is independently movable from each other.

5. The glove of claim 1, wherein the contour layer is preformed to fit the user's hand when the glove is worn by the user's hand.

6. The glove of claim 1, wherein the glove further includes a second padding section disposed between the at least one padding section and the strapping section along a length direction of the user's hand.

7. The glove of claim 1, wherein the glove includes an exterior layer formed by an inner single piece fabric and an outer single piece fabric to reduce a number of seaming location on the exterior layer of the glove.

8. The glove of claim 1, wherein the glove includes the contour layer inserted into a pocket formed on an inner side of an exterior layer such that the contour layer is replaced.

9. The glove of claim 1, wherein the strapping section includes a first strap and a second strap extending from the first strap in an opposite direction.

10. The glove of claim 9, wherein each of the first and second straps is wrapped around the user's wrist and crossed to each other through an opening formed in the second strap to secure the glove to the user's hand.

11. The glove of claim 1, wherein the glove includes an exterior layer formed by an inner single piece fabric and an outer single piece fabric joined to seam around edge lines of the inner and outer single piece fabrics of the exterior layer such that seaming locations joined between the inner single piece fabric and the outer single piece fabric are located in an inner side of the exterior layer.

12. A glove comprising:

a strapping section configured to secure the glove to a user's hand; and a padding section formed with a contour layer, at least one absorption layer, and at least one slip layer, the padding section configured to be disposed adjacent to a dorsal side of the user's hand, wherein each of the contour layer, the at least one absorption layer, and the at least one slip layer has a finger region and a hand body region, wherein the finger regions of the layers include surfaces faced and securely attached to each other by an adhesive material such that the surfaces of each layer in the finger regions are fixedly attached to each other and the hand body regions of each layer are independently and freely movable relative to each other, and wherein the padding section having the hand body region and the finger region is configured to distribute and absorb an impact load exerted on the dorsal side of the user's hand.

13. The glove of claim 12, wherein the glove further includes an exterior layer formed by an inner single fabric and an outer single fabric to reduce a number of seaming location on the exterior layer of the glove.

14. The glove of claim 13, wherein the exterior layer formed by each of the inner and outer single fabrics is configured to reduce wrinkles, protrusions, or rough features on the exterior layer of the glove.

15. The glove of claim 12, wherein the strapping section includes a first strap and a second strap extending from the first strap in an opposite direction, and each of the first and second straps is wrapped around a user's wrist and crossed to each other through an opening of the second strap.

16. The glove of claim 12, wherein the at least one slip layer comprises polytetrafluoroethylene (PTFE) and the contour layer comprises a low density foam.

17. The glove of claim 12, wherein the glove includes an exterior layer formed by an inner single piece fabric and an outer single piece fabric joined to seam around edge lines of the inner and outer single piece fabrics of the exterior layer such that seaming locations joined between the inner single piece fabric and the outer single piece fabric are located in an inner side of the exterior layer.

* * * * *